United States Patent [19]

Stephan

[11] Patent Number: 4,565,028

[45] Date of Patent: Jan. 21, 1986

[54] CHRISTMAS TREE STAND

[75] Inventor: Gerhard Stephan, Ottawa, Canada

[73] Assignee: AVA Tech International Ltd., Ottawa, Canada

[21] Appl. No.: 601,640

[22] Filed: Apr. 18, 1984

[30] Foreign Application Priority Data

Apr. 25, 1983 [CA] Canada ..... 426618
Jan. 17, 1984 [CA] Canada ..... 445421

[51] Int. Cl.[4] ..... A47G 7/00
[52] U.S. Cl. ..... 47/39; 47/42
[58] Field of Search ..... 47/40.5, 39, 42; 248/523, 524, 525

[56] References Cited

U.S. PATENT DOCUMENTS

| | | | |
|---|---|---|---|
| 2,014,896 | 9/1935 | Hollander | 47/40.5 |
| 2,867,398 | 11/1959 | Rose | 47/40.5 |
| 2,891,747 | 6/1959 | Steede | 47/40.5 |
| 3,322,909 | 2/1967 | Glassman | 47/40.5 |
| 3,524,280 | 8/1970 | McKinnon | 47/41.11 |
| 3,582,028 | 6/1971 | Purdy | 47/40.5 |
| 4,261,138 | 4/1981 | St. George Syms | 47/40.5 |

FOREIGN PATENT DOCUMENTS

| | | | |
|---|---|---|---|
| 304927 | 1/1929 | United Kingdom | 47/40.5 |

*Primary Examiner*—Robert A. Hafer
*Assistant Examiner*—Bradley M. Lewis
*Attorney, Agent, or Firm*—Murray Schaffer

[57] ABSTRACT

A stand for holding a tree or pole provided with a plurality of loop springs adapted automatically to accommodate tree trunks or poles of various diameters. The stand includes a plurality of stepped ribs below the springs, to secure a tree trunk or pole of a plurality of diameters, the springs and ribs together acting to hold a tree or pole in a secure, vertical position. Secondary, optional securement means are also provided by way of pivoting cams, in the event that the tree being supported is unusually heavy or large. The stand is effectively self-adjusting, to accommodate tree trunks and poles of a wide diameter range. The stand further incorporates a unitary water reservoir of commodious capacity.

10 Claims, 5 Drawing Figures

CHRISTMAS TREE STAND

This invention relates to a manually operable stand for holding a tree or pole, which automatically accommodates tree trunks or poles of different diameters.

It is common at present for tree stands to consist of eight separate parts of metal construction to be assembled by the purchaser. These parts are three legs, one bottom bowl, one metal ring and three screws. After a tree trunk has been inserted through the metal ring to the bottom of the bottom bowl, the three screws, held in place by the metal ring, must be tightened until the closest possible connection with the tree trunk has been achieved in order to hold the tree upright. The bottom part of such stand is formed like a bowl and held in place by the three separate metal legs inserted through three separate openings in the bowl and connecting to the metal ring. This bottom bowl is used for water storage to supply a necessary moisture to the tree while in the stand during its use.

Prior art tree or pole stands have many disadvantages. The most commonly available tree stand comprises eight parts which must be assembled by the consumer. To ensure an upright position of the tree inserted into prior art stands of the most common types, it is necessary for two persons to work together so that one person holds the tree upright and another person tightens screws in order to support the tree in an upright position. Prior art stands make it relatively difficult to achieve a solid and straight fit with the use of three screws, because tree trunks are generally relatively uneven in their configuration, so that one of the three supporting screws will tend to slide to one side of the trunk, instead of maintaining a straight, perpendicular relationship with the vertical axis of the trunk. Thus, prior art stands do not always securely support a tree and the trees will often tend to lean to one side or the other either immediately upon being secured in a stand or after a period of time. Further, after several uses prior art devices tend to wear, as screws are tightened and untightened, and make the stands effective life relatively short, so that the stand no longer is capable of securing a tree in firm upright position.

Further, prior art stands which include a base shaped as a bowl tend to have a relatively small water capacity, and in order to maintain a freshly cut tree it is necessary frequently to replenish the relatively small water reservoir in the base of prior art stands. Thus, trees supported in these prior art stands tend to dry out rapidly and to become a fire hazard.

The tree stand disclosed herein overcomes all of the foregoing disadvantages, and furthermore permits a single person to insert the trunk of a relatively heavy tree within the stand, the stand disclosed herein automatically accommodating tree trunks of various diameters.

Further, the stand disclosed herein has a unitary water reservoir of substantial capacity, so as to minimize the frequency with which the water supply contained therein must be replenished.

These and other advantages of this invention will become apparent with reference to the following description. Reference will be made to the attached drawings in which.

Detailed reference will now be made to the drawings, wherein like reference numerals identify like parts.

Figure 1:
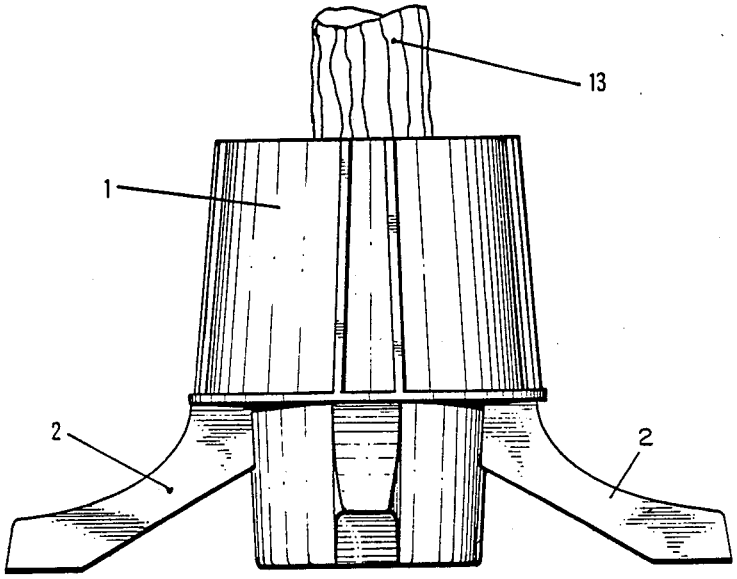
FIG. 1 is a side elevation of the tree/pole stand.

Referring to FIG. 1, the stand comprises a main body portion 1, and a plurality of legs 2. Ideally four legs 2 are provided, and as is evident in FIG. 3, legs 2 may be removably engaged with body 1, to minimize space required for storage, transport, and packaging of the stand. It will be evident, however, that legs 2 may be formed unitarily with the body of the stand 1.

Figure 2:
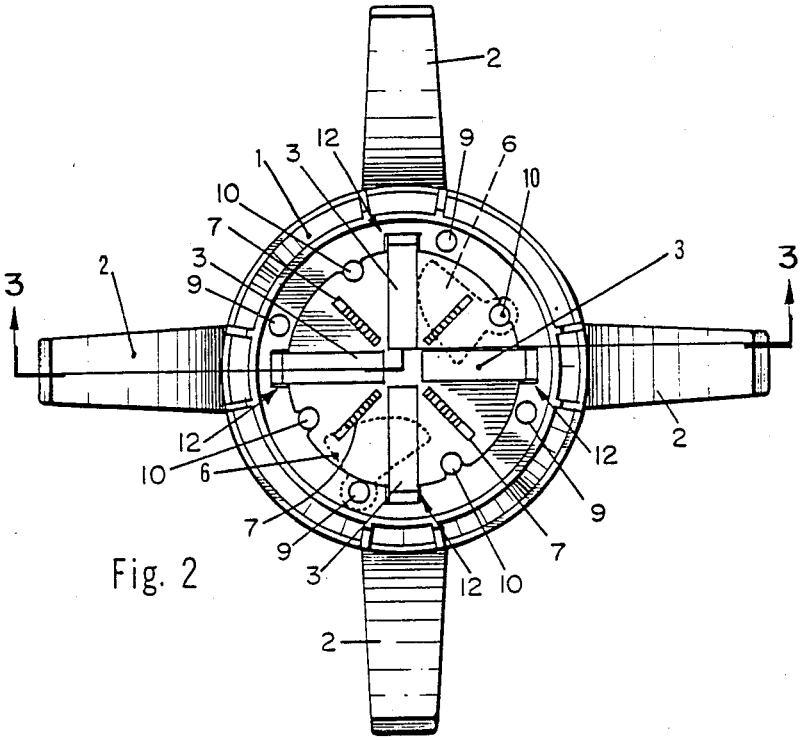
FIG. 2 is a top plan of the said stand.
Figure 3:
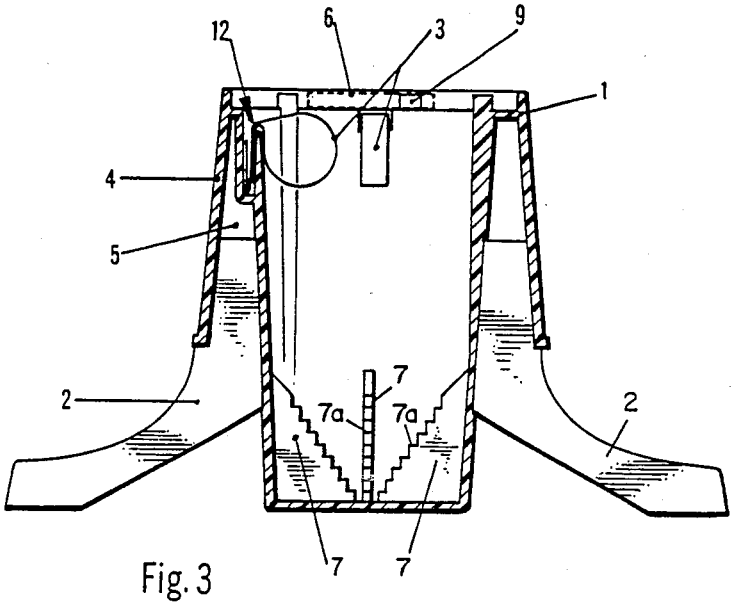
FIG. 3 is a vertical section taken along line 3—3 of FIG. 2.

Referring now to FIGS. 2 and 3, the interior of body 1, near its upper end is provided with a plurality of grooves or pockets 12, pockets 12 being open at their upper ends, and having a generally rectangular interior.

Figure 4:
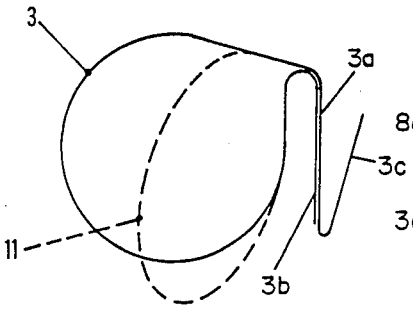
FIG. 4 is a side elevation of a self adjusting spring.
Figure 5:
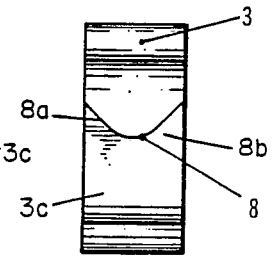
FIG. 5 is an end elevation of the spring of FIG. 4.

Referring to FIGS. 4 and 5, spring loops 3 are illustrated, springs 3 preferably being formed of rust resisting spring steel. Spring loops 3 includes a pair of downwardly depending ends 3*a*, 3*b*, end 3*a* including an upwardly extending unitary portion 3*c*, which may be provided with a downwardly extending notch 8, notch 8 serving to provide a pair of upwardly extending corners 8*a*, 8*b*. As seen most clearly in FIG. 3 the ends 3*a* and 3*b* of loop spring 3 is adapted to be engaged in pocket 12, with upwardly extending spring portion 3*c* being urged inwardly against the outer wall of pocket 12. The notched end of arm 3*c* will thus tend to bite slightly the outer wall of pocket 12, so that spring 3 will resist removal from pocket 12. As will become clear hereinafter, however, it is not desired that loop spring 3 be permanently engaged within pocket 12.

Referring to FIG. 2, it will be seen that the upper portion of body 1 is provided with four pockets 12 adapted to receive the ends 3*a*, 3*b* of four open loop springs 3, at 90° around the interior circumference of body 1.

Referring now to FIGS. 2 and 3, a plurality of angled stepped ribs 7 are provided in the interior of body 1, near the bottom thereof. Stepped ribs 7 are unitary with the interior of body 1, and are triangular in shape, with the outer faces thereof having a plurality of steps, 7*a*. Four stepped ribs are provided, at right angles within the interior circumference of body 1, and at a 45° angle relationship with springs 3. Stepped ribs 7 are adapted to receive the bottom of a tree trunk (or pole) 13, when inserted within the body of stand 1, and to ensure that the base of the trunk 13 is automatically centered at the bottom of stand body 1.

With the foregoing description in mind it is believed that the operation of the stand according to the invention is very simple and straightforward. A tree trunk 13 is manually urged downwardly in the centre of body 1, causing loop springs 3 to compress, until the base of trunk 13 is engaged by stepped ribs 7. Referring to FIG. 4, loop spring 3 is illustrated in phantom line, in a compressed position as might be caused by a tree trunk or the like inserted centrally within body 1. Springs 3 thus automatically compress against the urging of trunk 13, and act to restrain the trunk centrally within body 1 of the stand. As the base of trunk 13 has been automatically centered by stepped ribs 7, a vertical positioning of trunk 13 is assured.

To further assure the stability of a tree or pole mounted and supported by the stand, the following optional securement means is provided.

As illustrated in broken lines in FIG. 2 a plurality of cams or wedges 6 are provided. Cam 6 is also illustrated in broken lines in FIG. 3. Provided around the upper rim of body 1 are a plurality of unitary, upwardly projecting studs or fingers 9 and 10, adapted to serve as retainers and pivot points for studs 6. As is clear in FIG. 2, four such studs 9 are provided at 90° around the inner circumference of body 1, nearer the outer edge thereof than a second set of four such studs 10, provided nearer the interior of body 1. Thus, if the circumference of the tree trunk being supported by the stand is relatively large, studs 9 will be used to support cam wedges 6, while if the trunk is relatively smaller then studs 10 will be employed. It will be seen that cam wedges 6 may be pivoted inwardly toward the centre of body 1, so that opposed cams engage diametrically opposite sides of the trunk being supported, to ensure its stability within the stand.

As is evident from FIGS. 2 and 3 the interior of body 1 is relatively commodious, and thus capable of containing a relatively large quantity of water, as is desirable when the stand is used to support a recently cut tree, to ensure a long, safe display life therefor.

As disclosed above, loop springs 3 are removably engaged within pockets 12, and while the end portion 3c of loop springs 3 are designed to resist upward movement, it has been found that the effect of springs 3 against a tree trunk 13 engaged therebetween is such that the tree trunk 13 may be difficult to remove therefrom. In other words, when loop springs 3 are in the compressed position illustrated by reference numeral 11 in FIG. 4, the loop springs 3 tend to resist any further compression when an attempt is made to move tree trunk 13 upwardly. Accordingly, it will facilitate removal of a tree trunk of pole from within the stand, if the loop springs are capable of relatively easy upward release from within pockets 12.

As will be evident, the main function of the stand disclosed and described will be at Christmas time, but it will also be evident that use may be made at any time of the year, for any period of time, for the purpose of holding any tree or pole, for any purposes desired.

The foregoing is by way of example and the invention should be limited only by the scope of the appended claims.

The embodiments of the invention in which an exclusive property or privilege is claimed are defined as follows:

1. A stand for trees or poles comprising a cylindrical container supported by a plurality of legs;

said container comprising a body having a unitary bottom, side wall, and an open top;

said wall having a plurality of pockets opening in the same direction as said top and being formed therein near the upper interior thereof;

a plurality of springs each having a straight portion forming a downwardly directed end inserted within a respective pocket; and a closed loop extending into said body; and a plurality of ribs integrally formed with said bottom and side wall of said body near the bottom interior thereof, said ribs having an edge conically inclined outwardly from the bottom toward the top and being stepped to securely engage a tree inserted in said body, said loops and said ribs cooperating to maintain said tree vertical.

2. A stand for trees or poles according to claim 1, said plurality of spring-receiving pockets and said plurality of stepped ribs being equally spaced-apart in said body.

3. A stand for trees or poles according to claim 1, said loop springs being adapted to be removably received in said pockets.

4. A stand for trees or poles according to claim 1, said legs being removably engageable with restraining pockets formed on the outer wall of said body, near the bottom thereof.

5. A stand for trees or poles according to claim 1, said body being adapted to provide an interior water reservoir.

6. A stand for trees or poles according to claim 1, said body including a plurality of equally spaced upwardly projecting lugs near the outer top thereof, said lugs being adapted to provide pivotal support for a plurality of cam wedges.

7. A stand for trees or poles according to claim 1 or claim 6, said body, said loop springs and said wedges all being of rust-resistant material.

8. A stand for trees or poles according to claim 6, said cam wedges being adapted to releasably secure the trunk of a tree or lower end of as pole inserted in said stand.

9. A stand for trees or poles comprising:

a cylinderical container having unitary body having a bottom, a side wall, and an open top;

leg means associated with said body for supporting said container;

a plurality of loop springs engaged on the inside of said side wall having a straight portion forming an end and a curved portion forming a loop, and wherein said body is formed with a plurality of uniformly spaced pockets about its circumferences for removably retaining the straight portion of said springs;

a plurality of ribs at or near the interior bottom of said body; and a plurality of horizontally disposed cam wedges, means for mounting said wedges adjacent the inner peripheral edge along the open top to pivot about a vertical axis within said body near the top thereof, said cams being adapted to be manually pivoted against said tree trunk or pole whereby a tree trunk or pole inserted centrally in said body will be retained in a vertical position by cooperation of said loop springs, ribs and cam wedges.

10. The stand according to claim 9 wherein said means for mounting said wedges comprises a first and a second set of lugs projecting upwardly adjacent the top of said side wall, the lugs of said first set being uniformly spaced about the circumference of said side wall at a first predetermined radial distance from the center thereof and the lugs of said second set being uniformly spaced about the circumference of said side wall at a different distance from the center and said wedges have a hole for placement over said legs.

* * * * *

UNITED STATES PATENT AND TRADEMARK OFFICE

CERTIFICATE OF CORRECTION

PATENT NO. : 4,565,028

DATED : January 21, 1986

INVENTOR(S) : Gerhard STEPHAN

It is certified that error appears in the above-identified patent and that said Letters Patent are hereby corrected as shown below:

On the cover page, Item [73] should read:

--[73] Assignee: AVA TECH INTERNATIONAL LTD., Ottawa, Canada and M.R. St. JACQUES ASSOCIATES, INC., Nepean, Canada, --.

Signed and Sealed this

Twenty-fifth Day of November, 1986

*Attest:*

DONALD J. QUIGG

*Attesting Officer* *Commissioner of Patents and Trademarks*